United States Patent [19]

Henderickson

[11] Patent Number: 4,812,046

[45] Date of Patent: Mar. 14, 1989

[54] DEVICE FOR MIXING TWO MATERIALS

[76] Inventor: Carl Henderickson, P.O. Box 81, Sheridan, Wyo. 82801

[21] Appl. No.: 784,114

[22] Filed: Oct. 4, 1985

[51] Int. Cl.[4] ..... B01F 5/00; B01F 11/00

[52] U.S. Cl. ..... 366/111; 222/200; 366/162; 366/338

[58] Field of Search ..... 366/110, 111, 117, 112, 366/118, 338, 162, 339, 212, 240, 108, 154, 600; 222/459, 135, 196, 200, 527; 99/451

[56] References Cited

U.S. PATENT DOCUMENTS

| | | | |
|---|---|---|---|
| 1,088,357 | 2/1914 | Morse | 366/336 X |
| 1,456,147 | 5/1923 | Putnam | 366/110 |
| 2,339,092 | 1/1944 | Meltzer | 366/110 |
| 2,356,004 | 8/1944 | Price | 366/110 |
| 3,165,299 | 1/1965 | Balamuth et al. | 222/200 X |
| 3,763,873 | 10/1973 | Saunders | 366/108 X |
| 3,949,904 | 4/1976 | Hendrickson | 366/162 |
| 4,202,635 | 5/1980 | Hendrickson | 366/162 |

*Primary Examiner*—Harvey C. Hornsby
*Assistant Examiner*—Scott J. Haugland

[57] ABSTRACT

A device for mixing at least two materials as they are discharged to pass through a flexible mixing tube to a nozzle characterized by an arrangement to move or shake the tube to change the configuration of the tube as the material passes therethrough. Preferably, the tube includes a mixing element which is loosely received therein and moved independently within the tube to cause a stirring of the material as it is moving along the tube.

6 Claims, 2 Drawing Sheets

60
61
63
80
21
53
85
90
IV
VI
VIII

DEVICE FOR MIXING TWO MATERIALS

BACKGROUND OF THE INVENTION

The present invention is directed to a mixing device, preferably a portable mixing device, for mixing two materials and dispensing the mixed materials under pressure through a nozzle.

In my U.S. Pat. No. 3,949,904, whose disclosure is incorporated by reference thereto, a portable dispensing or mixing device for use with an epoxy gun which mix the two constituents or materials of a desired proportion and dispenses the mixed materials under pressure through a nozzle was disclosed. The device of this patent utilized a rotating mixing element in a mixing chamber.

A second type of mixing device, which is portable, is disclosed in my U.S. Pat. No. 4,202,635, whose disclosure is incorporated by reference thereto. In this portable mixing device, the mixing is accomplished by passing the two materials that are to be mixed together through a mixing tube of flexible material containing a helical mixing element. Due to the bends in the tube and to the helical element, the mixing will occur between the two materials. The helical mixing element may be a twisted strip of material or metal. The mixing element may also be a helical coil of wire which is loosely received in the mixing tube. The mixing tube having the helical mixing element is a static mixing device which has the advantage that problems of sealing a rotating mixing element, which problem may occur in the first-mentioned type, are eliminated.

SUMMARY OF THE INVENTION

The present invention is directed to an improvement on the mixing of the above-mentioned static mixing device which improvements provide a better mixing of the two materials as they pass through a mixing tube.

To accomplish these goals, the invention is directed to a device for mixing at least two materials in desired proportions and dispensing the materials under pressure from a nozzle, said device comprising a separate container for each of the materials, each container having means for discharging the contents of the container under pressure from a discharge tube, a mixing tube of flexible material having a discharge end and an inlet end, a nozzle attached to the discharge end, coupling means for coupling the discharge tubes of each of the containers to the inlet end of the tube and means for improving the mixing of the material passing through the tube. The means for improving the mixing can include providing a chain disposed in the mixing tube and extending along the length thereof such as from the inlet end to the discharge end to provide a mixing element in the tube. In another embodiment, the means for improving comprises means for vibrating or shaking the mixing tube so that the tube is moved to continually change the curvature of the tube to improve mixing of the materials. In the embodiment with the means for vibrating, a mixing element, which may be a rod, a loose-fitting helical coil or a chain, may be disposed in the tube and the element is able to shift in the tube during vibration to improve mixing of the contents being forced along the length of the tube.

Advantages of the invention will be readily apparent to a person from the drawings and following description and claims.

DESCRIPTION OF THE PREFERRED EMBODIMENTS

Figure 1:
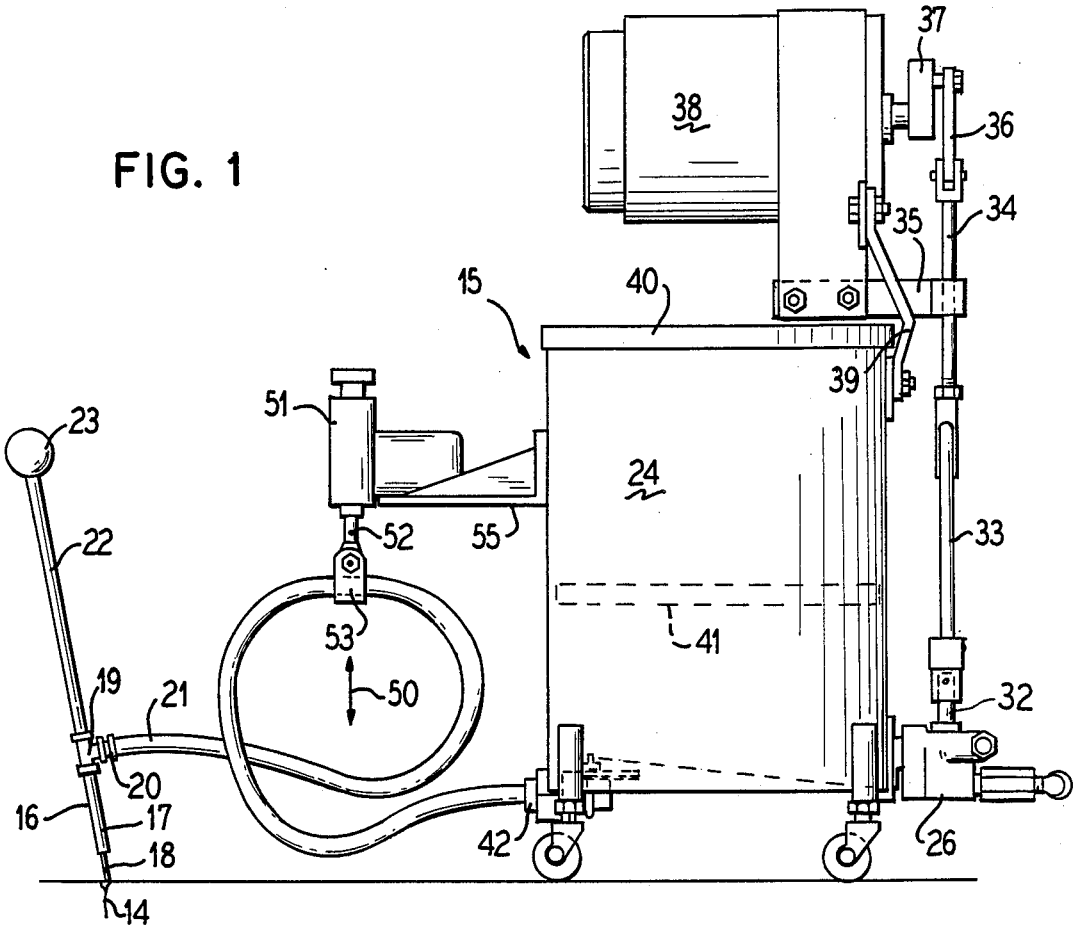
FIG. 1 is a side view of a portable mixing device in accordance with the present invention.
Figure 2:
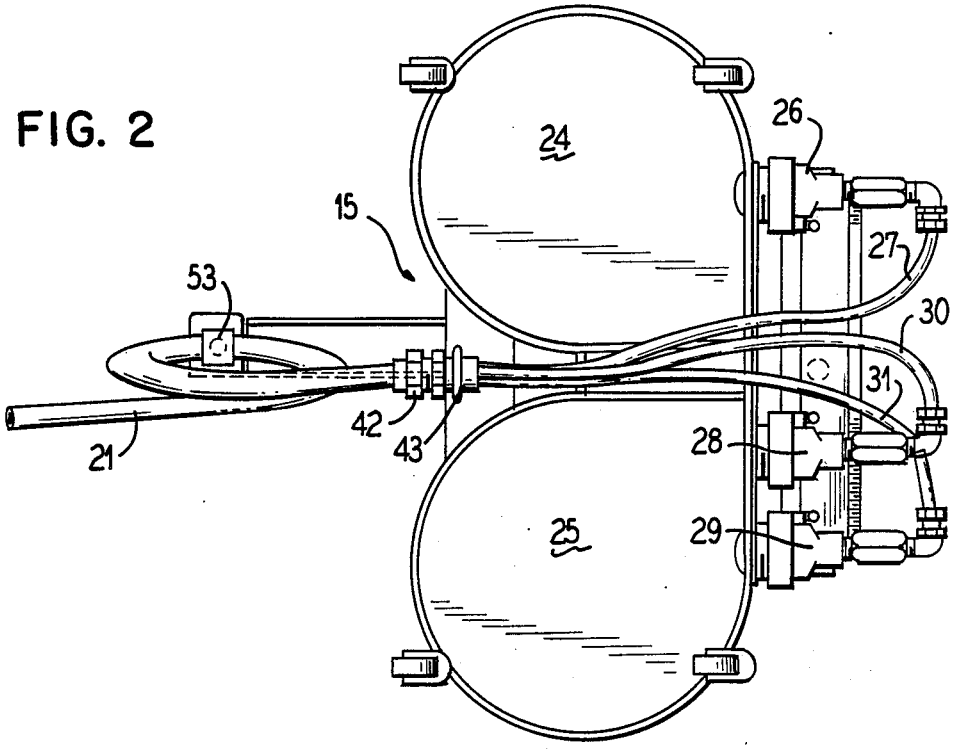
FIG. 2 is a partial plan view of the bottom of the containers illustrated in FIG. 1.

The principles of the present invention are particularly useful when incorporated in a portable mixing device generally indicated at 15 in FIGS. 1 and 2 and is shown for filling cracks 14 in a surface. The device 15 mixes two materials in a desired proportion and dispenses the mixed materials under pressure through a nozzle 16. As best illustrated, the nozzle 16 has a tubular portion 17 terminating at a needle-like nose 18, which may either be a tapered or a thin needle which is shown being used to insert the mixture into the cracks 14. The tubular portion 17 is attached to a tee 19, which is connected by a hose coupling 20 to a discharge end of a flexible mixing tube 21. The other end of the tee 19 receives a member 22 terminating in a ball grip 23, which enables the operator to position the nozzle 16.

The device 15 as best illustrated in FIG. 2 includes a first container 24 and a second container 25. Each of the containers has means for supplying its contents under pressure. As illustrated, the device 15 utilizes a grease gun pump with a container 24 having a single pump element 26 discharging through a check valve into a discharge tube 27. The container 25 has two pump elements 28 and 29 with the pump element 28 discharging through a check valve into a discharge tube 30 while the pump 29 discharges through a check valve into a discharge tube 31. As illustrated, each of the pumps 26, 28 and 29 have a piston such as the piston 32 for the pump 26 (FIG. 1) connected to a common member 33 which is reciprocated in a vertical position by a shaft 34 which is guided in a bracket 35. To reciprocate the shaft 34, an appropriate linkage 36 connects the shaft 34 to a crank 37 which is rotated by an electric motor 38 which is supported on the device 15 by a bracket 39. Thus, each of the grease gun pumps 26, 28 and 29 is reciprocated in the same time by the motor 38 which forms a part of the means for reciprocating the pump elements and each pump discharges a fixed amount of material under pressure. It should also be pointed out that each of the containers is provided with a lid such as the lid 40 for the container 24 and the contents of each of the containers supports a following disk 41.

To connect the mixing tube 21 to the three discharge tubes 29, 30 and 31, an input end of the tube 21 has a coupling 42 which is connected to coupling means 43. The coupling means 43 sealingly receives each of the tubes 27, 30 and 31 with the tubes being arranged around the axis of the coupling 43. Thus, the coupling 42 when threaded on the threaded portion of the coupling 43 connects the mixing tube 21 to the discharge tubes 27, 30 and 31 to receive the material following therethrough. It should be noted that the description of the device at this point is substantially the same as the device disclosed in the above-mentioned U.S. Pat. No. 4,202,635.

In the embodiments illustrated in FIGS. 1 through 9, the improvement is that the flexible mixing tube 21 is constantly placed in a reciprocating motion to continually change the curvature of the tube by moving the tube in an up and down motion indicated by an arrow 50 in FIG. 1. As illustrated, this is accomplished by vibrating or shaking means 51 which has a reciprocating shaft 52 connected by a bracket 53 to the flexible tube 21. The shaking means 51, as illustrated, is mounted on a bracket 55 which is secured to a frame supporting the containers 24 and 25. In the illustrated embodiment, the shaking means is a vibrating unit of a portable saber saw in which the bracket 53 is attached to the blade holder as the housing of the saber saw is mounted on the bracket 55. Other means of vibrating or reciprocating over a short distance can be utilized such as another electric motor rotating a crank which is connected by a linkage to the clamp 53. It is also envisioned that the vibrating means 51 could utilize an electromagnetic arrangement to cause a movement of the hose in the direction of the double arrow 50.

In each of the embodiments illustrated in FIGS. 3–9, the flexible hose or mixing tube 21 is made of a flexible material such as rubber reinforced with a metal fabric so that the tube can withstand pressures up to 8000 psi. The tube 21 is a commercially available tube and has an internal surface 60. As illustrated in the embodiments of FIGS. 3–9, the tube is held by the hose clamp 53 which in its simplest construction has a U shape to wrap around the mixing tube with the ends of the U shape being held together by a fastener such as a nut and bolt arrangement 61. One side of the U-shaped member 63 is secured to the reciprocating shaft 52.

Figures 3, 4, 5, 6, 7, 8, 9, 10:
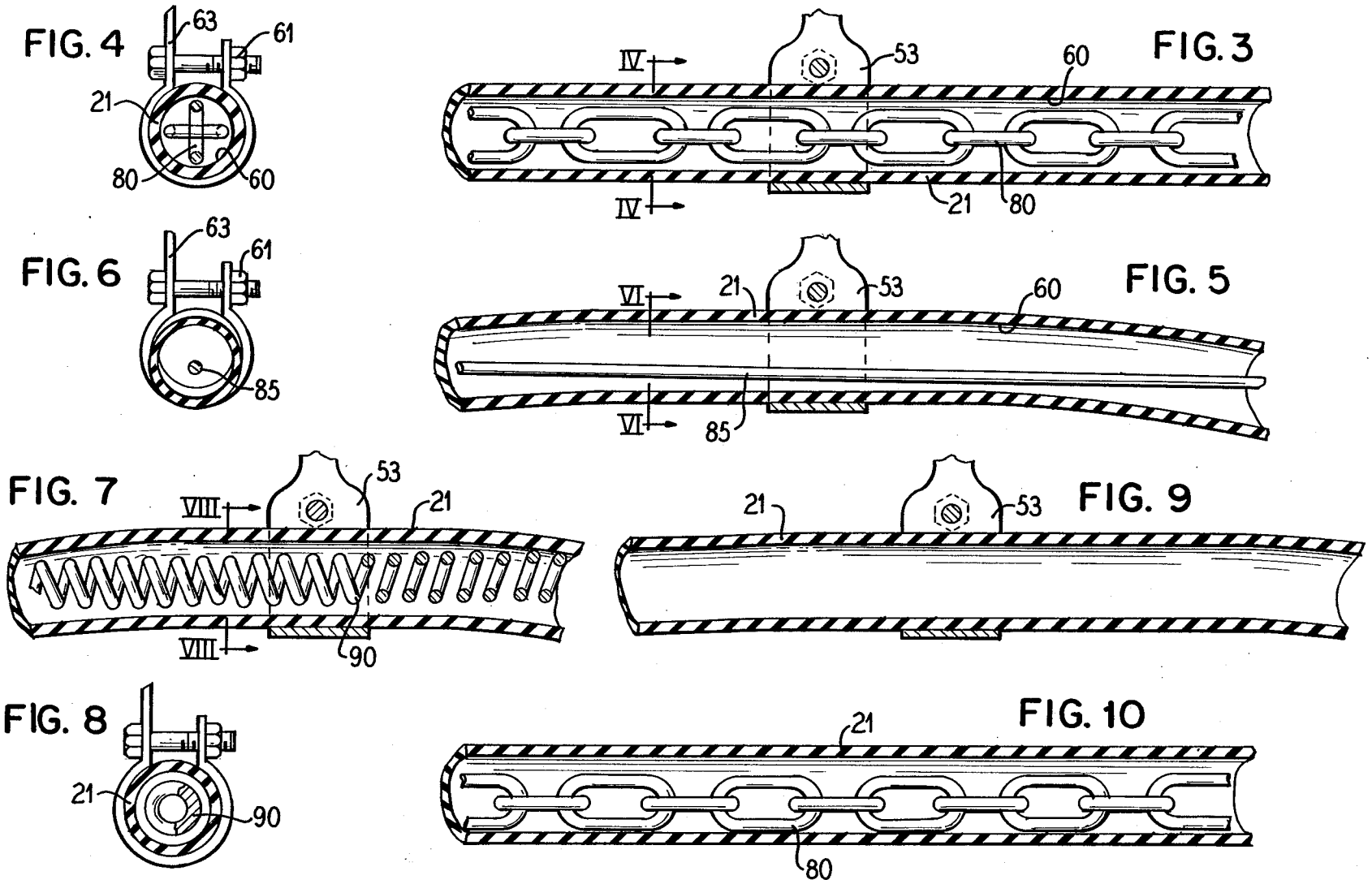
FIG. 3 is a longitudinal cross-sectional with portions in elevation of the mixing tube and an embodiment of the mixing element according to the present invention.
FIG. 4 is a cross-sectional view taken along lines IV—IV of FIG. 3.
FIG. 5 is a longitudinal cross-sectional view of a modification of the mixing tube with an embodiment of a mixing element in accordance with the present invention.
FIG. 6 is a cross-sectional view taken along lines VI—VI of FIG.
FIG. 7 is a longitudinal cross-sectional view of another modification of the mixing element of the present invention.
FIG. 8 is a cross-sectional view taken along lines VIII—VIII of FIG. 7.
FIG. 9 is a longitudinal cross-sectional view of the mixing tube of the present invention without a mixing element.
FIG. 10 is a longitudinal cross-sectional with portions in elevation of a static mixing tube with an improved mixing element.

In the embodiment illustrated in FIG. 9, the mixing tube 21 is free of a mixing element and the mixing occurs due to the movement of the tube 21 created by the shaking means 51. This movement causes a continuous change in the curvature of the tube which causes some mixing of the two materials as they pass therealong.

While the movement of the mixing tube 21 will cause some mixing, it has been found that mixing is improved if a mixing element is loosely received in the mixing tube 21 and is heavy enough to move relatively in or to the tube. For example, a chain 80 which is formed of a plurality of interlocking links. Preferably the chain 80 extends along a substantial length and in the preferred embodiment is anchored to extend between the inlet and outlet ends of the mixing tube 21. As illustrated, the chain 80 preferably has a smaller outer dimension than the interior diameter of the surface 60 of the tube 21. Thus, any movement of the tube 21 due to the means for shaking causes the chain to move back and forth inside of the mixing tube to increase the mixing of the materials due to a stirring action caused by the movement of the chain. Also, it should be noted that even without vibrating or moving the tube, the material as it passes along the chain will move into and out of the links to get a mixing action.

In another embodiment, the mixing element is a rod or wire member 85 (FIGS. 5 and 6) which is loosely received in the mixing tube 21. Thus, movement of the tube by the vibrating means 51 causes a shifting of the rod or wire 85 within the tube to cause a stirring or mixing action of the materials as they pass therealong.

In another embodiment illustrated in FIGS. 7 and 8, a mixing element in the form of a helical spring 90 is loosely received in the tube 21. As in the above-mentioned U.S. Pat. No. 4,202,635, the helical spring 90 has an outer diameter which is substantially smaller than the inner diameter of the tube so that the shaking or movement of the tube 21 will allow the helical spring to move back and forth within the interior of the tube. While the helical coil member is illustrated as having a constant diameter, it could be of the various designs disclosed and illustrated in the above-mentioned patent.

In an embodiment illustrated in FIG. 10, the tube 21 is free from any connecting element 53 and contains a chain 80 as the mixing element. As mentioned hereinabove, the movement of the various materials around the links of the chain will cause mixing. It is also contemplated in accordance with the present invention that the chain can be caused to shift within the tube 21 by utilizing a chain which is of a magnetic material and creating an intermittent magnetic force to attraction the chain and to shift the chain within the tubing 21.

As mentioned hereinabove, the improvements enable mixing material without utilizing moving parts which extend through the mixing chamber or container. Thus, movement either of the mixing tube by itself; the mixing tube and the element; or the element by itself causes a dynamic mixing in addition to the static mixing that occurs by passing the two materials through the curved tube particularly the tube having a mixing element. It has been found that the mixing device of the present invention particularly the mixing tube having the mixing element and an arrangement for shifting both the tube and the element gives an improved mixing over that which was obtained with my portable mixer disclosed in the above-mentioned U.S. Pat. No. 4,202,635.

Although various minor modifications may be suggested by those versed in the art, it should be understood that I wish to embody within the scope of the patent granted hereon, all such modifications as reasonably and properly come within the scope of my contribution to the art.

I claim:

1. A device for mixing at least two materials in a desired proportion and dispensing the materials under pressure from a nozzle, said device comprising a separate container for each of the materials, each container having means for discharging the contents of the container under pressure from a discharge tube, a mixing tube of flexible material having a discharge end and an inlet end, a nozzle attached to the discharge end, coupling means for coupling the discharge tubes of each of the containers into the inlet end of the mixing tube, a mixing element being disposed in the mixing tube and extending over a substantial length of said mixing tube said mixing element being flexible and loosely received in said mixing tube, and means for moving the mixing element relative to the mixing tube to stir the materials passing through the mixing tube, said means for moving engaging an outer surface of said mixing tube.

2. A device according to claim 1, wherein the mixing element is a chain having links, said links being movable relative to each other and to the mixing tube due to the means for moving the mixing element.

3. A device for mixing at least two materials in desired proportions and dispensing the materials under pressure from a nozzle, said device comprising a separate container for each of the materials, each container have means for discharging the contents of the container under pressure from a discharge tube, a mixing tube of flexible material having a discharging end and an inlet end, a mixing element being loosely received inside of said mixing tube, said element being a chain having interconnecting links, a nozzle attached to the discharge end, coupling means for coupling each the discharge tube of each container into the inlet end of the mixing tube, and means for shaking the mixing tube so that the mixing tube and element are constantly moving relative to each other to stir the materials passing through the mixing tube and the mixing tube is constantly changing its configuration to also improve the mixing of the materials passing through the mixing tube.

4. A device for mixing at least two materials in a desired proportion and dispensing the materials under pressure from a nozzle, said device comprising a separate container for each of the materials, each container having means for discharging the contents of the container under pressure from a discharge tube, a mixing tube of flexible material having a discharge end and an inlet end, a nozzle attached to the discharge end, a coupling means for coupling the discharge tube of each of the containers into the inlet end of the mixing tube, a length of chain having interconnected links being disposed loosely in the mixing tube so that materials passing through the length of the mixing tube are subdivided and combined by passing around the links of the chain, and means for shaking the mixing tube to cause relative movement of the chain in the mixing tube to cause a stirring of the material passing through the length of the mixing tube and a changing of the mixing tube configuration.

5. A device according to claim 4, wherein the means for shaking the mixing tube comprises a clamp connected to a portion of the mixing tube and said clamp being connected to a reciprocating shaft.

6. A device according to claim 1, wherein the means for moving the mixing element includes a shaft, means for reciprocating the shaft, and means attached to the shaft for gripping the mixing tube.

* * * * *